US007721928B2

(12) United States Patent
Chen et al.

(10) Patent No.: US 7,721,928 B2
(45) Date of Patent: May 25, 2010

(54) NAIL-DRIVING DEVICE WITH SAFETY UNIT

(75) Inventors: Jin-Chi Chen, Taichung (TW); Chun-Chi Lai, Taichung (TW)

(73) Assignee: Basso Industry Corp., Taichung (TW)

( * ) Notice: Subject to any disclaimer, the term of this patent is extended or adjusted under 35 U.S.C. 154(b) by 123 days.

(21) Appl. No.: 12/176,203

(22) Filed: Jul. 18, 2008

(65) Prior Publication Data

US 2009/0250498 A1 Oct. 8, 2009

(30) Foreign Application Priority Data

Apr. 7, 2008 (TW) ..... 97112480 A

(51) Int. Cl.
*B25C 1/04* (2006.01)

(52) U.S. Cl. ..... 227/8; 227/110; 227/119; 227/32

(58) Field of Classification Search ..... 227/8, 227/110, 119, 32, 120
See application file for complete search history.

(56) References Cited

U.S. PATENT DOCUMENTS 4,629,106 A * 12/1986 Howard et al. ..... 227/8
5,193,730 A * 3/1993 Tanaka et al. ..... 227/8
5,662,257 A * 9/1997 Mukoyama et al. ..... 227/8
5,836,501 A * 11/1998 Lai ..... 227/8
5,862,969 A * 1/1999 Lee ..... 227/8
6,394,332 B2 * 5/2002 Akiba ..... 227/8
6,641,018 B2 * 11/2003 Akiba ..... 227/8
6,820,788 B2 11/2004 Akiba et al.
6,974,062 B2 * 12/2005 Akiba ..... 227/8
7,484,647 B2 * 2/2009 Yang ..... 227/8

* cited by examiner

*Primary Examiner*—Brian D Nash
(74) *Attorney, Agent, or Firm*—Fox Rothschild, LLP; Robert J. Sacco

(57) ABSTRACT

A nail-driving device includes a body having a nail ejection portion, a nail-striking member, an activation switch, a trigger mechanism, a force-transmitting member, and a safety mechanism. The force-transmitting member is connected pivotally to the safety mechanism. When the safety mechanism is limited in a first position, and when the trigger mechanism is actuated, the force-transmitting member activates the activation switch to thereby move the nail-striking member relative to the body. When movement of the safety mechanism relative to the body is allowed, and when the trigger mechanism is actuated, the force-transmitting member moves the safety mechanism from the first position to a second position such that a contact portion of the activation switch serves as a fulcrum.

13 Claims, 13 Drawing Sheets

NAIL-DRIVING DEVICE WITH SAFETY UNIT

CROSS-REFERENCE TO RELATED APPLICATION

This application claims priority of Taiwanese Application No. 097112480, filed on Apr. 7, 2008.

BACKGROUND OF THE INVENTION

1. Field of the Invention

This invention relates to a nail-driving device, and more particularly to a nail-driving device that includes a safety unit.

2. Description of the Related Art

Referring to FIGS. 1, 2, and 3, a nil gun disclosed in U.S. Pat. No. 6,820,788 has a safety mechanism 6 for preventing misfires. The safety mechanism 6 includes an upper safety portion 601, a lower safety portion 602, and a cam member 503 connected between the upper and lower safety portions 601, 602 such that the upper and lower safety portions 601, 602 can be interconnected or disconnected from each other. To protect the cam member 603, a shielding member 7 is provided to cover the same. However, during use, due to the presence of the shielding member 7, it is difficult to register a nail 9 to be ejected with a hole 801 in a workpiece 8.

SUMMARY OF THE INVENTION

The object of this invention is to provide a nail-driving device that includes a safety unit for preventing misfires and that can overcome the above-mentioned drawback associated with the prior art.

According to this invention, a nail-driving device comprising:

a body having a nail ejection portion extending along an axial direction;

a nail-striking member movable within the body along the axial direction;

an activation switch disposed on the body and having a contact portion, the activation switch being connected to the nail-striking member such that, when the contact portion is moved and thus retracted into the body, the activation switch activates the nail-striking member to move within the body;

a trigger unit including a trigger mechanism disposed pivotally on the body and adjacent to the activation switch, and a first resilient member disposed between the body and the trigger mechanism, the trigger mechanism being pivotable on the body between a non-firing position and a firing position, the first resilient member biasing the trigger mechanism toward the non-firing position; and a safety unit including a safety mechanism movable within the nail ejection portion, a force-transmitting member mounted to the safety mechanism and adjacent to the trigger mechanism, and a second resilient member disposed between the body and the safety mechanism, the safety mechanism having a first distal end, and a second distal end opposite to the first distal end, the safety mechanism being movable relative to the nail ejection portion along the axial direction between a first position and a second position farther away from the nail ejection portion than the first position, the second resilient member biasing the safety mechanism toward the first position, the force-transmitting member having a connecting end disposed pivotally on the first distal end of the safety mechanism, and a driven end opposite to the connecting end and adjacent to the trigger mechanism, wherein: when the safety mechanism is limited in the first position, and when the trigger mechanism is pivoted to the firing position, the force-transmitting member moves the contact portion so that the contact portion is retracted into the body; and when movement of the safety mechanism between the first and second positions is allowed, and when the trigger mechanism is pivoted to the firing position, the force-transmitting member is driven by the trigger mechanism to move the safety mechanism from the first position to the second position such that the contact portion serves as a fulcrum.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 4:
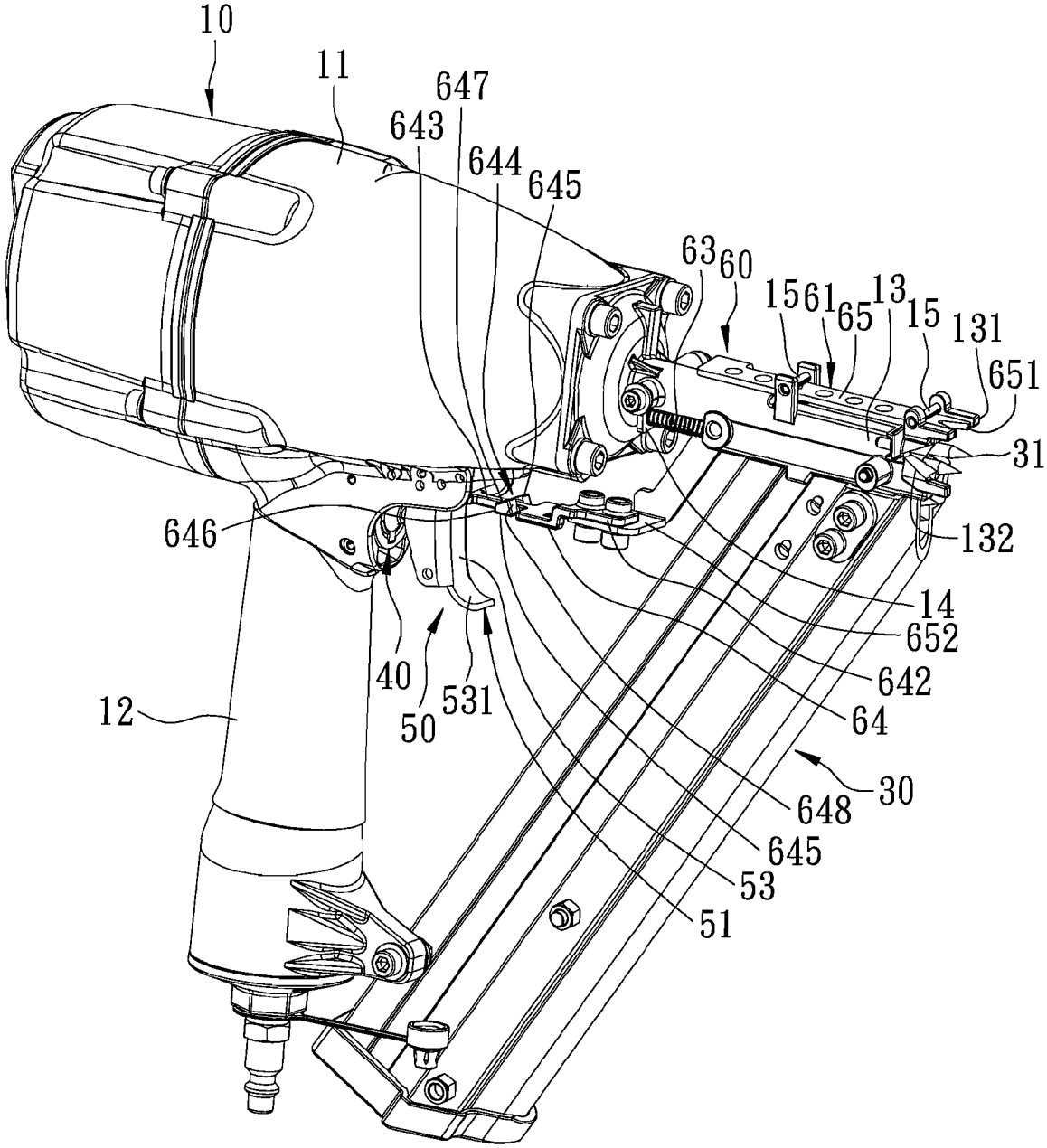
FIG. 4 is a perspective view of the preferred embodiment of a nail-driving device according to this invention when a trigger mechanism is disposed in a non-firing position and a safety mechanism is disposed in a first position.
Figure 5:
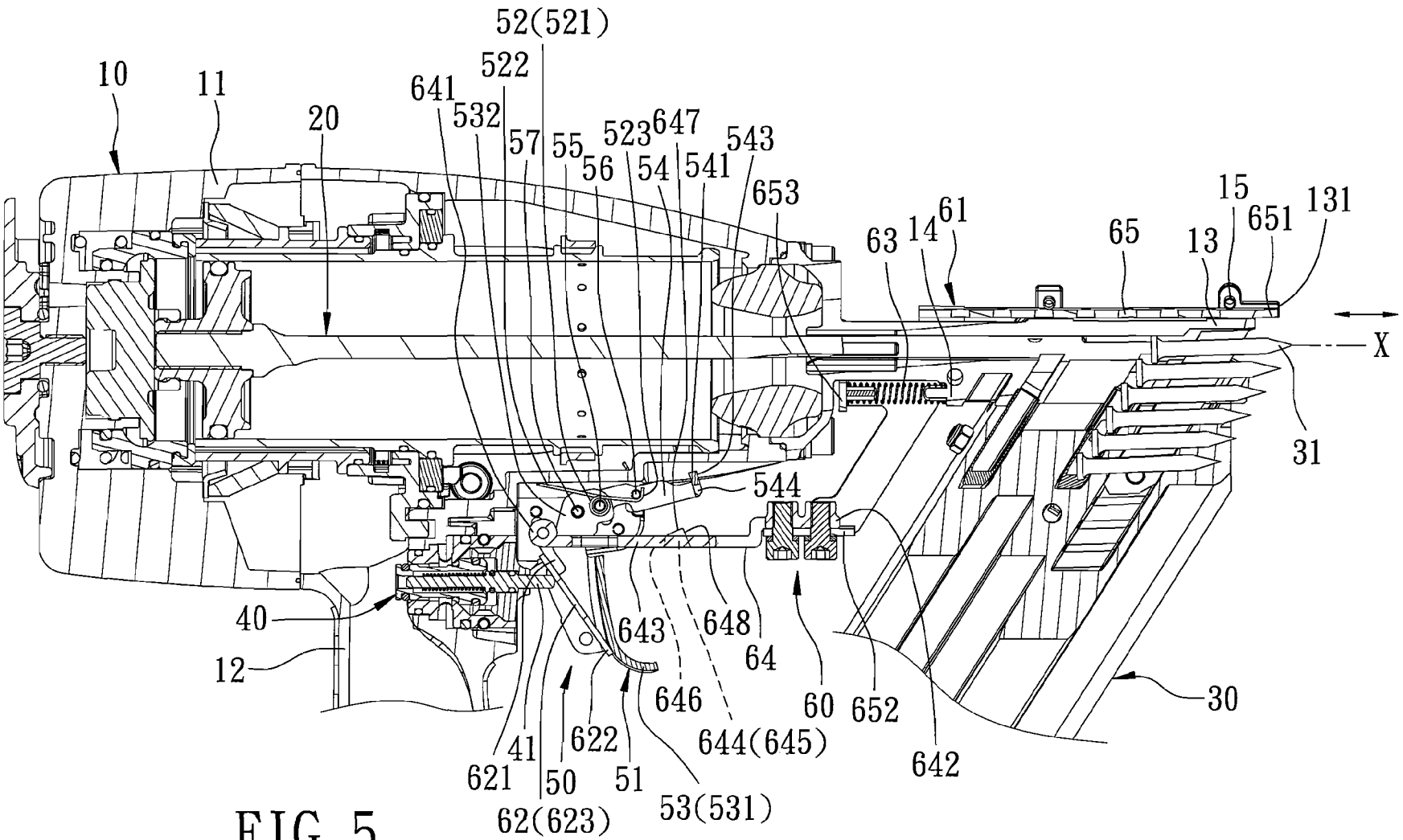
FIG. 5 is a fragmentary schematic sectional side view of the preferred embodiment when the trigger mechanism is disposed in the non-firing position and the safety mechanism is disposed in the first position.
Figure 6:
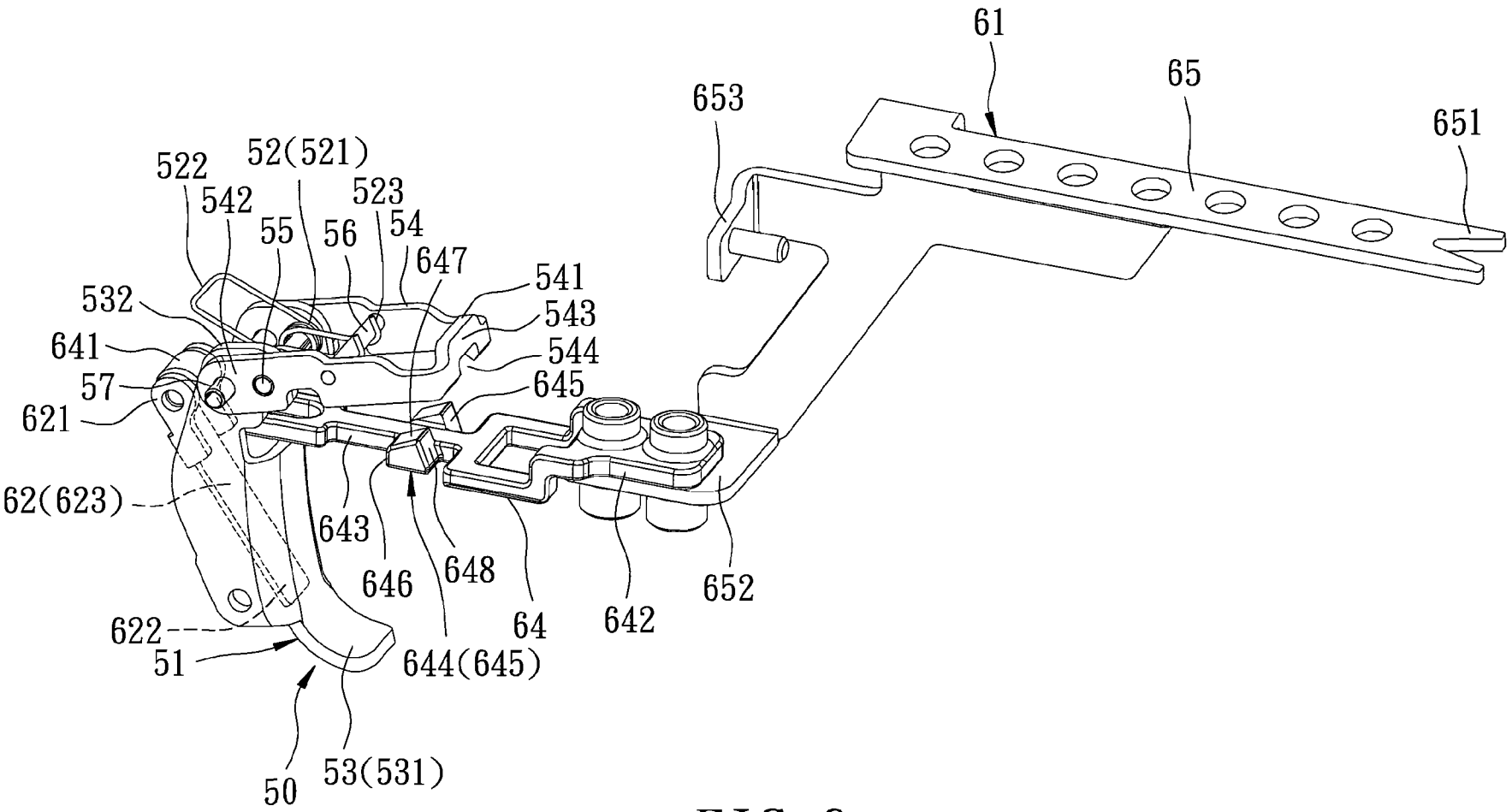
FIG. 6 is a fragmentary perspective view of a trigger unit and the safety mechanism.

Referring to FIGS. 4, 5, and 6, the preferred embodiment of a nail-driving device 3 according to this invention includes a body 10, a nail-striking member 20, a magazine 30, an activation switch 40, a trigger unit 50, and a safety unit 60.

The body 10 has an accommodating portion 11, a handle 12 connected to the accommodating portion 11, a nail ejection portion 13 connected to the accommodating portion 11 and extending forwardly from the accommodating portion 11 along an axial direction (X), a first abutment portion 14 disposed at the nail ejection portion 13 and facing the accommodating portion 11, and two guide pins 15 disposed rotatably on and above the nail ejection portion 13 and spaced apart from each other along the axial direction (X) The nail ejection portion 13 has a front end 131 and two side notches 132.

The nail-striking member 20 is movable within the accommodating portion 11 along the axial direction (X), and extends into the nail ejection portion 13.

The magazine 20 is connected between the nail ejection portion 13 and the handle 12 for receiving a plurality of nails 31.

The activation switch 40 is disposed at a junction between the accommodating portion 11 and the handle 12 of the body 10, and has a contact portion 41 extending forwardly along the axial direction (X). When the contact portion 41 is moved and retracted into the body 10, the activation switch 40 activates the nail-striking member 20 to move forwardly along the axial direction (X) to thereby eject one of the nails 31 from the nail ejection portion 13.

The trigger unit 50 includes a trigger mechanism 51 disposed pivotally on the junction of the accommodating portion 11 and the handle 12 and adjacent to the activation switch 40, and a first resilient member 52 disposed between the accommodating portion 11 and the trigger mechanism 51.

The trigger mechanism 51 includes a trigger member 53, a locking member 54 disposed on the trigger member 53, a positioning pin 55, a retaining pin 56, and a pivot pin 57.

The trigger member 53 has an actuated end 531, and a top end 532 opposite to the actuated end 531.

The locking member 54 has a locking end 541, and a mounting end 542 opposite to the locking end 541. The locking end 541 has a stop end surface 543, and a recess 544 formed in a bottom surface thereof and through the locking end 541 along the axial direction (X).

The positioning pin 55 extends through the top end 532 of the trigger member 53 and the mounting end 542 of the locking member 54. The retaining pin 56 is disposed fixedly on the locking member 54 and between the locking end 541 and the mounting end 542. The pivot pin 57 extends through the top end 532 of the trigger member 53, the mounting end 542 of the locking member 54, and is connected to the body 10.

In this embodiment, the first resilient member 52 is configured as a torsion spring, and has a spring coil 521 sleeved on the positioning pin 55, a first end foot 522 abutting against the accommodating portion 11, and a second end foot 523 abutting against the retaining pin 45.

Figure 7:
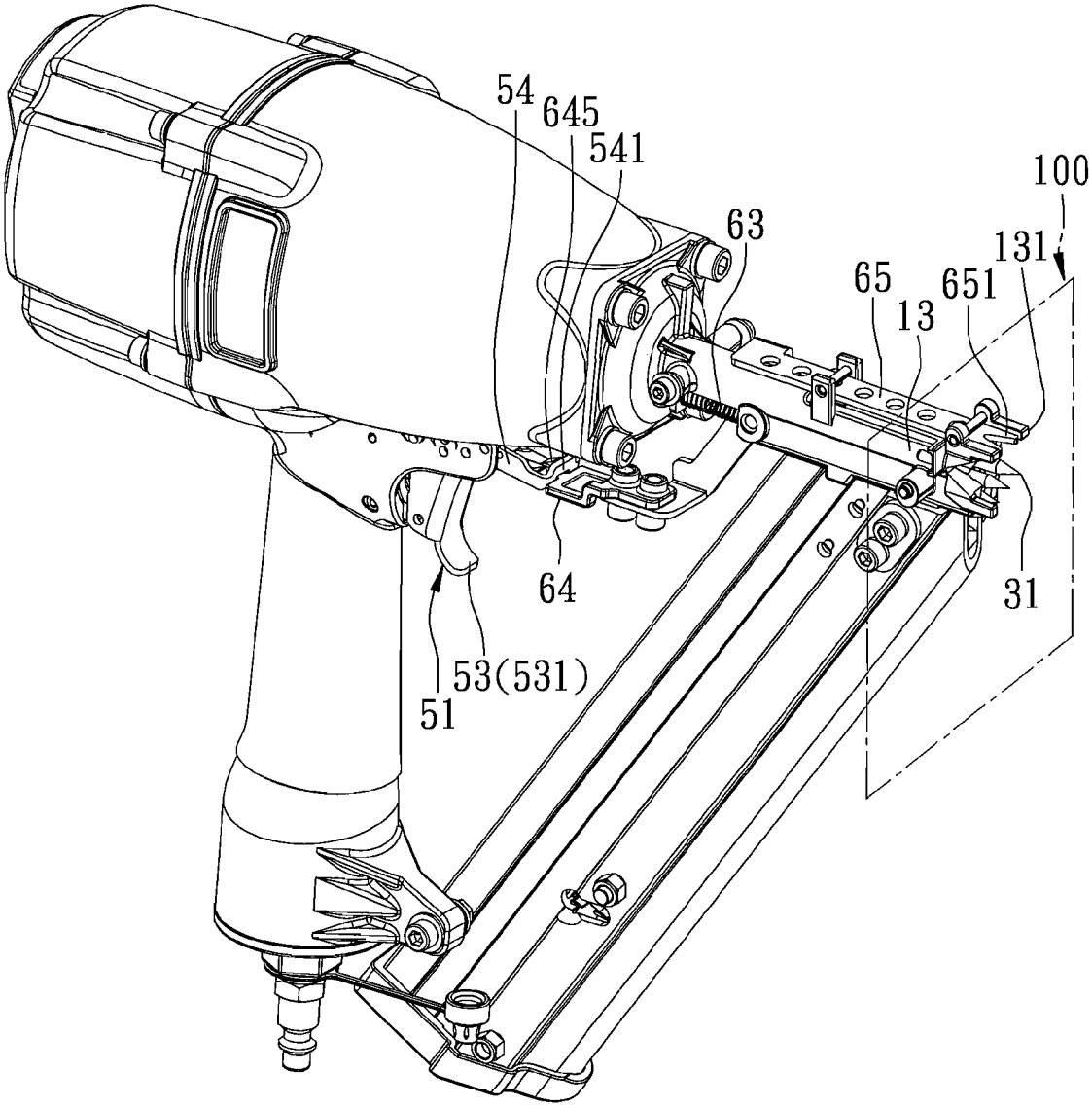
FIG. 7 is a perspective view of the preferred embodiment when the trigger mechanism is disposed in a firing position and when the safety mechanism is limited in the first position.
Figure 8:
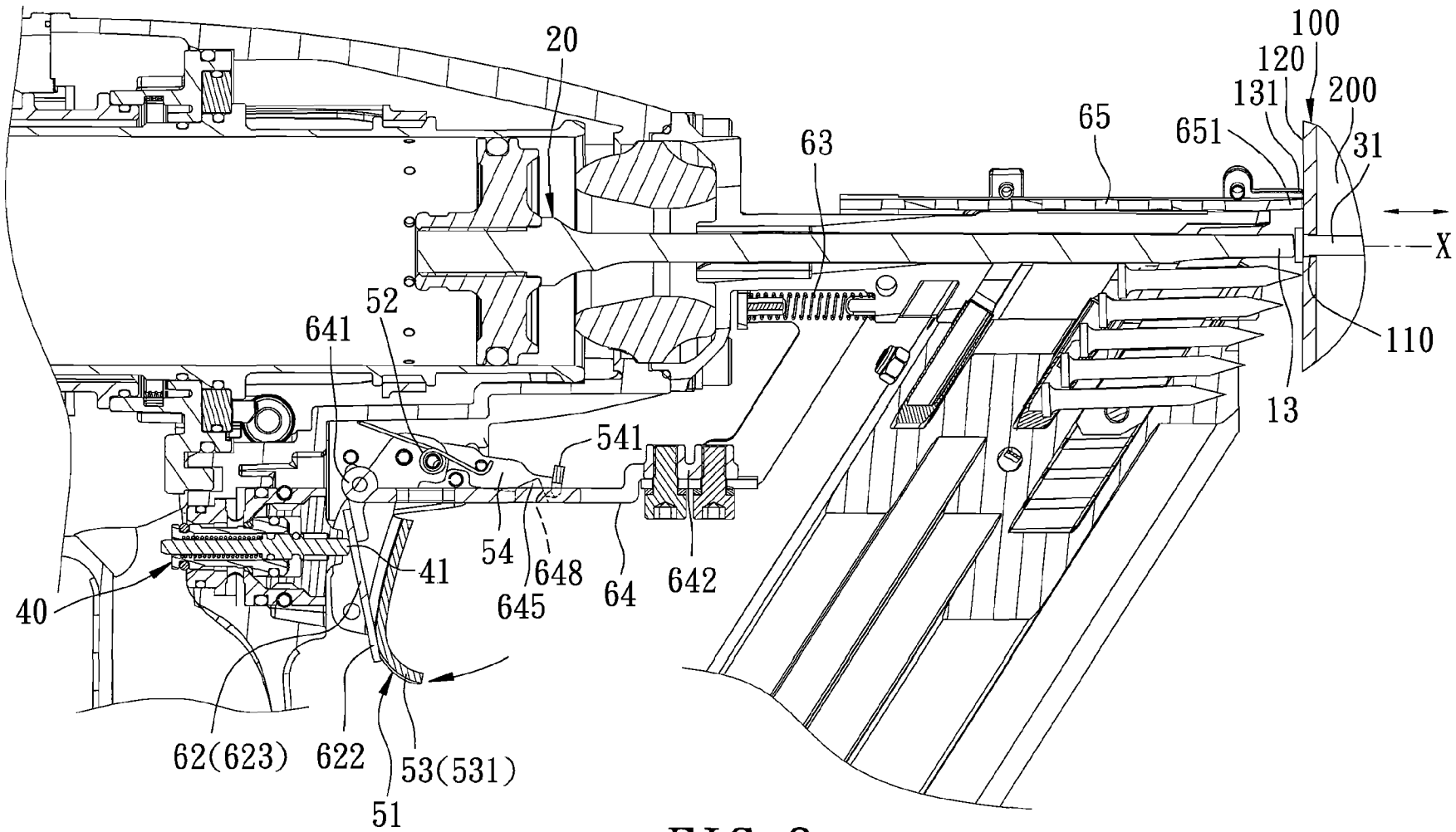
FIG. 8 is a fragmentary schematic sectional side view of the preferred embodiment when the trigger mechanism is disposed in the firing position and when the safety mechanism is limited in the first position.

The trigger mechanism 51 is pivotable on the body 10 about the pivot pin 57 between a non-firing position shown in FIGS. 4 and 5 and a firing position shown in FIGS. 7 and 8. The first resilient member 52 biases the trigger mechanism 51 toward the non-firing position.

The safety unit 60 includes a safety mechanism 61 movable within the nail ejection portion 13 along the axial direction (X), a force-transmitting member 62 mounted to the safety mechanism 61 and adjacent to the trigger mechanism 51, and a second resilient member 63 disposed between the body 10 and the safety mechanism 61.

The safety mechanism 61 has a first safety member 64 and a second safety member 65 connected fixedly to and disposed in front of the first safety member 64.

The first safety member 64 has a first distal end 641 adjacent to the trigger mechanism 51, a first connecting end 542 opposite to the first distal end 641, an intermediate section 643 extending between the first distal end 641 and the first connecting end 642 along the axial direction (X), and a position-limiting portion 644 disposed at the intermediate section 643. The position-limiting portion 644 includes two spaced-apart symmetric position-limiting blocks 645. Each of the position-limiting blocks 645 has a stop surface 646 facing the first distal end 641, a first inclined surface 647 facing the first distal end 641, and a second inclined surface 648 connected to the first inclined surface 647 and facing the first connecting end 642.

The second safety member 65 is disposed movably on the nail ejection portion 13 of the body 10, and extends between the nail ejection 13 and the guide pins 15. The second safety member 65 has a second distal end 651 and a second connecting end 652 opposite to the second distal end 651 and connected fixedly to the first connecting end 642, and a second abutment portion 63 located between the second distal end 651 and the second connecting end 652.

The force-transmitting member 62 has a connecting end 621 disposed pivotally on said first distal end 641 of the safety member 64, a driven end 622 opposite to the connecting end 621 and adjacent to the actuated end 531 of the trigger member 53, and a force-transmitting section 623 extending between said connecting end 621 and the driven end 622 and in contact with the contact portion 41 of the activation switch 40.

In this embodiment, the second resilient member 63 is configured as a compression spring, and has two ends abutting respectively against the first and second abutment portions 14, 653.

Figure 9:
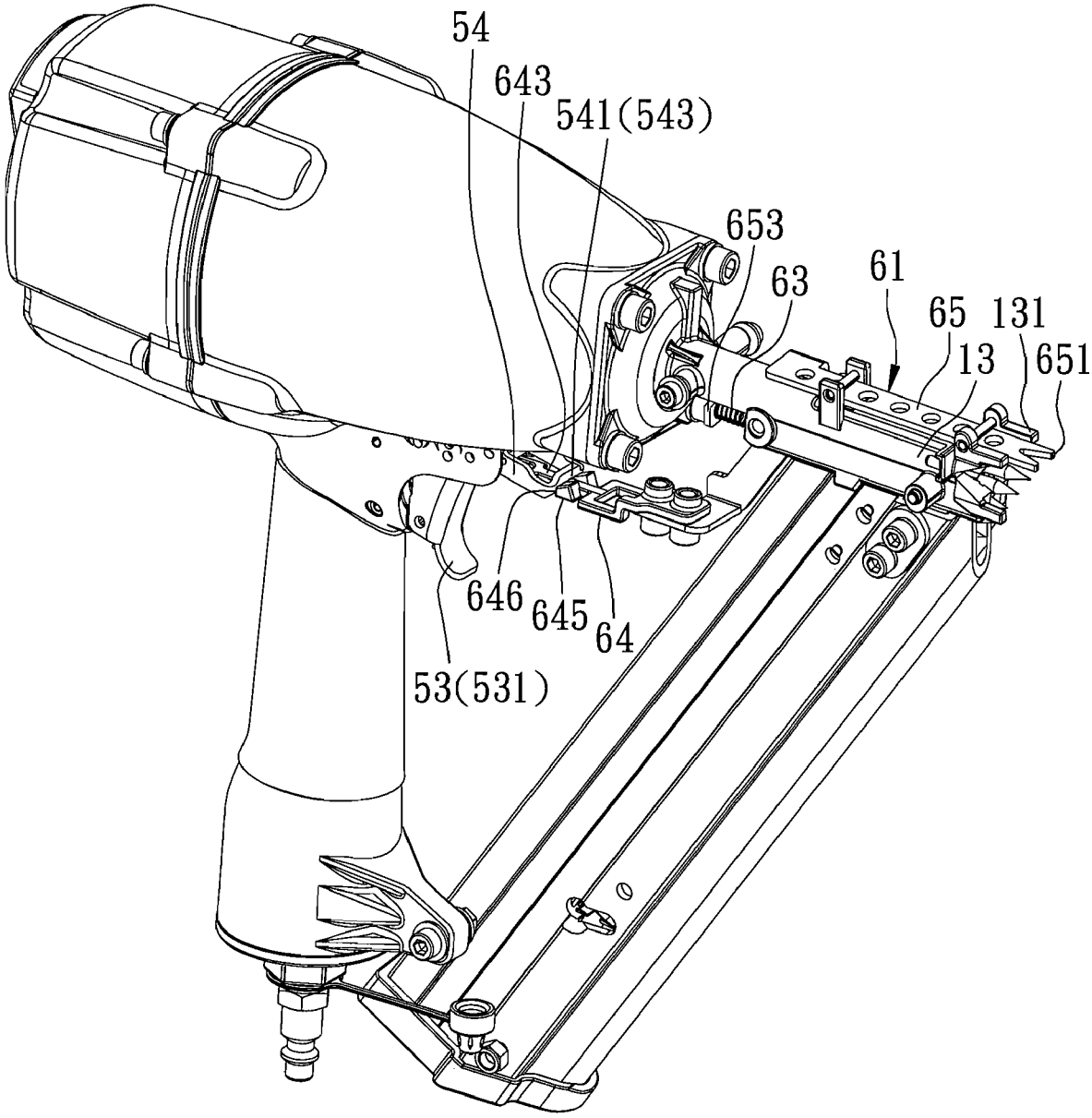
FIG. 9 is a perspective view of the preferred embodiment when the trigger mechanism is disposed in the firing position and when the safety mechanism is disposed in a second position.
Figure 10:
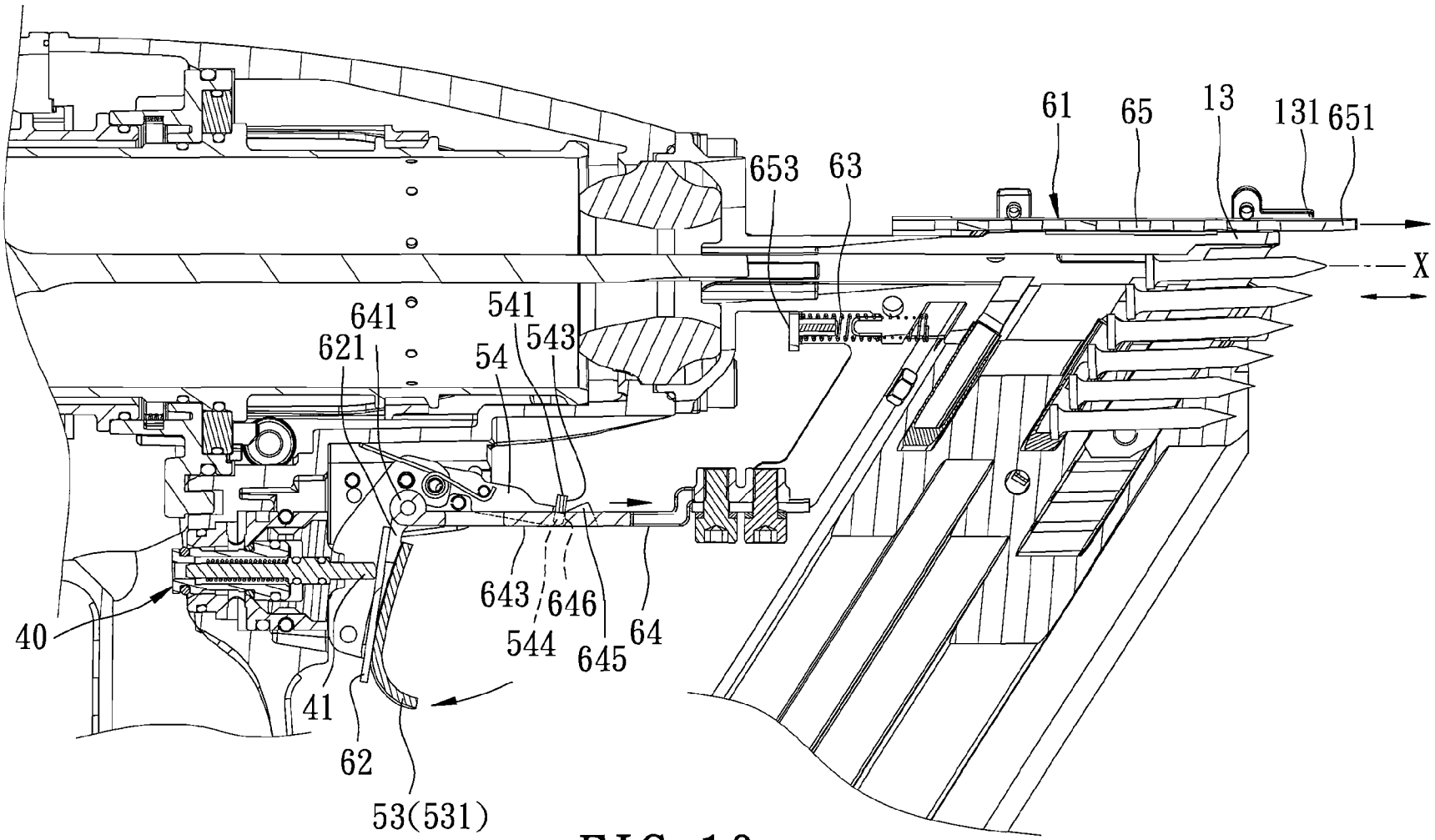
FIG. 10 is a fragmentary schematic sectional side view of the preferred embodiment when the trigger mechanism is disposed in the firing position and the safety mechanism is disposed in the second position.

The safety mechanism 61 is movable relative to the nail ejection portion 13 along the axial direction (X) between a first position shown in FIGS. 4 and 5 and a second position shown in FIGS. 9 and 10. The second position is farther away from the nail ejection portion 13 than the first position. The second resilient member 63 biases the safety mechanism 61 toward the first position. When the safety mechanism 61 is disposed in the first position, the first distal end 641 of the first safety member 64 is adjacent to the activation switch 40. When the safety mechanism 61 is moved from the first position toward the second position, the first distal end 641 is moved away from the activation switch 40.

With reference to FIGS. 7 and 8, when it is desired to fix a workpiece 100 onto a wall 200, a tip of one nail 31 projecting from the nail ejection portion 13 is registered with a hole 110 in the workpiece 100, and the front end 131 of the nail ejection portion 13 and the second distal end 651 of the second safety member 65 are brought into contact with a surface 120 of the workpiece 100. Because of contact between the second distal end 651 of the second safety member 65 with the workpiece 100, the safety mechanism 61 is limited in the first position, and is not able to move relative to the body 10 along the axial direction (X). Afterwards, the actuated end 531 of the trigger member 53 is pressed to pivot the trigger mechanism 51 to the firing position. Hence, the force-transmitting section 623 of the force-transmitting member 62 moves the contact portion 41 so that the contact portion 41 is retracted into the body 10. As a result, the activation switch 40 is activated to move the nail-striking member 20 to thereby eject the nail 31. At the same time, the locking end 541 of the locking member 54 is moved to a position between the first connecting end 642 and the second inclined surfaces 648 of the position-limiting blocks 645 and adjacent to the second inclined surfaces 648.

Conversely, with reference to FIGS. 9 and 10, when the front end 131 of the nail ejection portion 13 and the second distal end 651 of the second safety member 65 are not in contact with any workpiece, movement of the safety mechanism 61 relative to the body 10 is allowed, that is, the safety mechanism 61 is not limited in the first position. In this state, when the actuated end 531 of the trigger member 53 is pressed, the connecting end 621 of the force-transmitting member 62 is moved forwardly such that the contact portion 41 of the activation switch 40 serves as a fulcrum. Hence, the safety mechanism 61 is moved from the first position to the second position. In the second position, the second distal end 651 of the second safety member 62 is projected forwardly from the front end 131 of the nail ejection portion 13, the second resilient member 63 is compressed, and the recess 544 of the locking end 541 of the locking member 54 engages the intermediate section 643 of the first safety member 64. Further, the locking end 541 of the locking member 54 is disposed between the first distal end 641 of the first safety member 64 and the stop surfaces 646 of the position-limiting blocks 645 and adjacent to the stop surfaces 646. As such, if the second distal end 651 of the second safety member 65 is pushed unintentionally and rearwardly, the stop surfaces 646 of the position-limiting blocks 645 come into contact with the stop end surfaces 543 of the locking end 541 of the locking member 54, thereby preventing the safety mechanism 61 from moving rearwardly to the first position. Thus, as long as the front end 131 of the nail ejection portion 13 and the second distal end 651 of the second safety member 65 are not in contact with any workpiece, misfires can be prevented.

Figure 1:
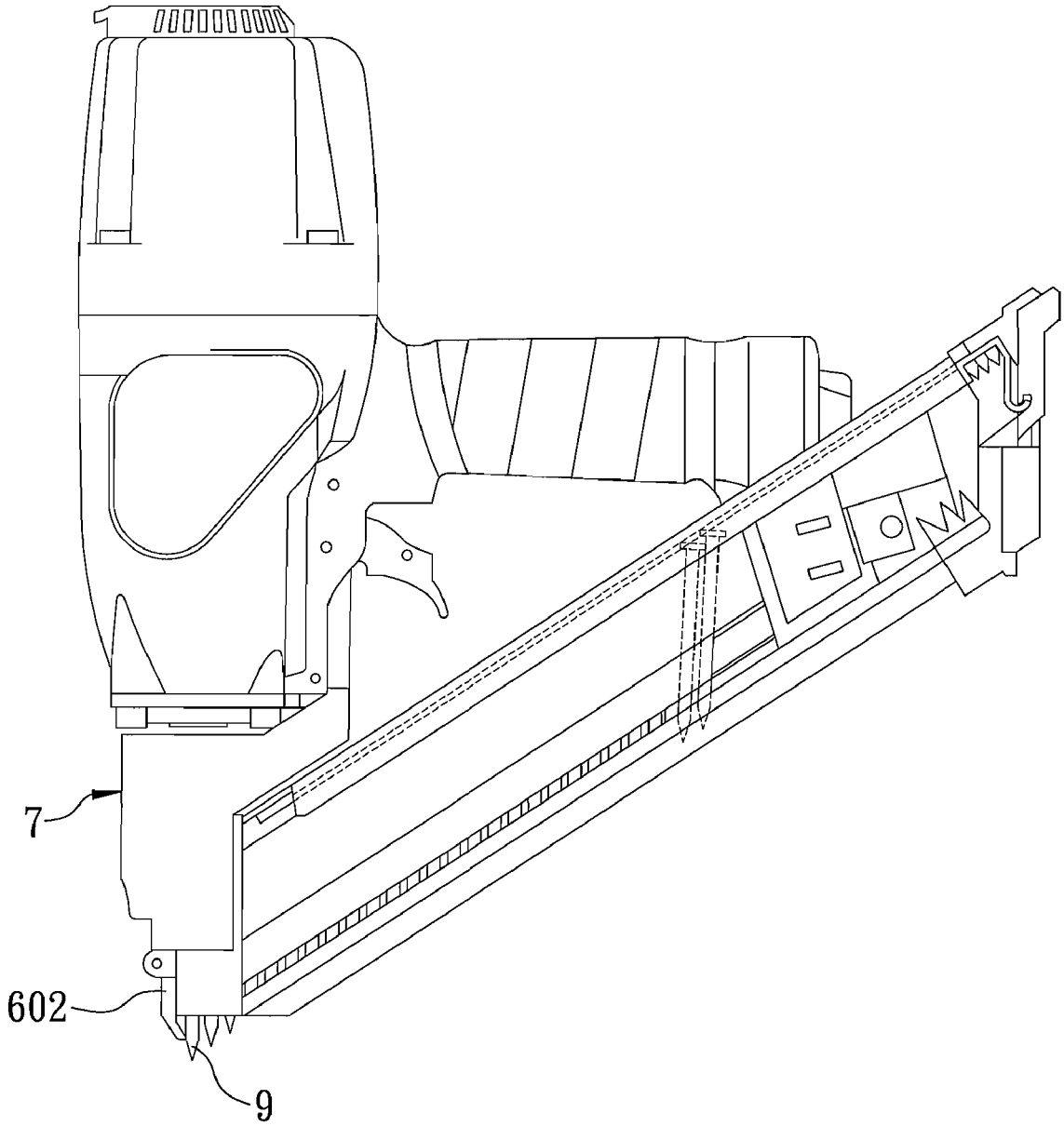
FIG. 1 PRIOR ART
FIG. 1 is a side view of a conventional nail gun disclosed in U.S. Pat. No. 6,820,788.
Figure 2:
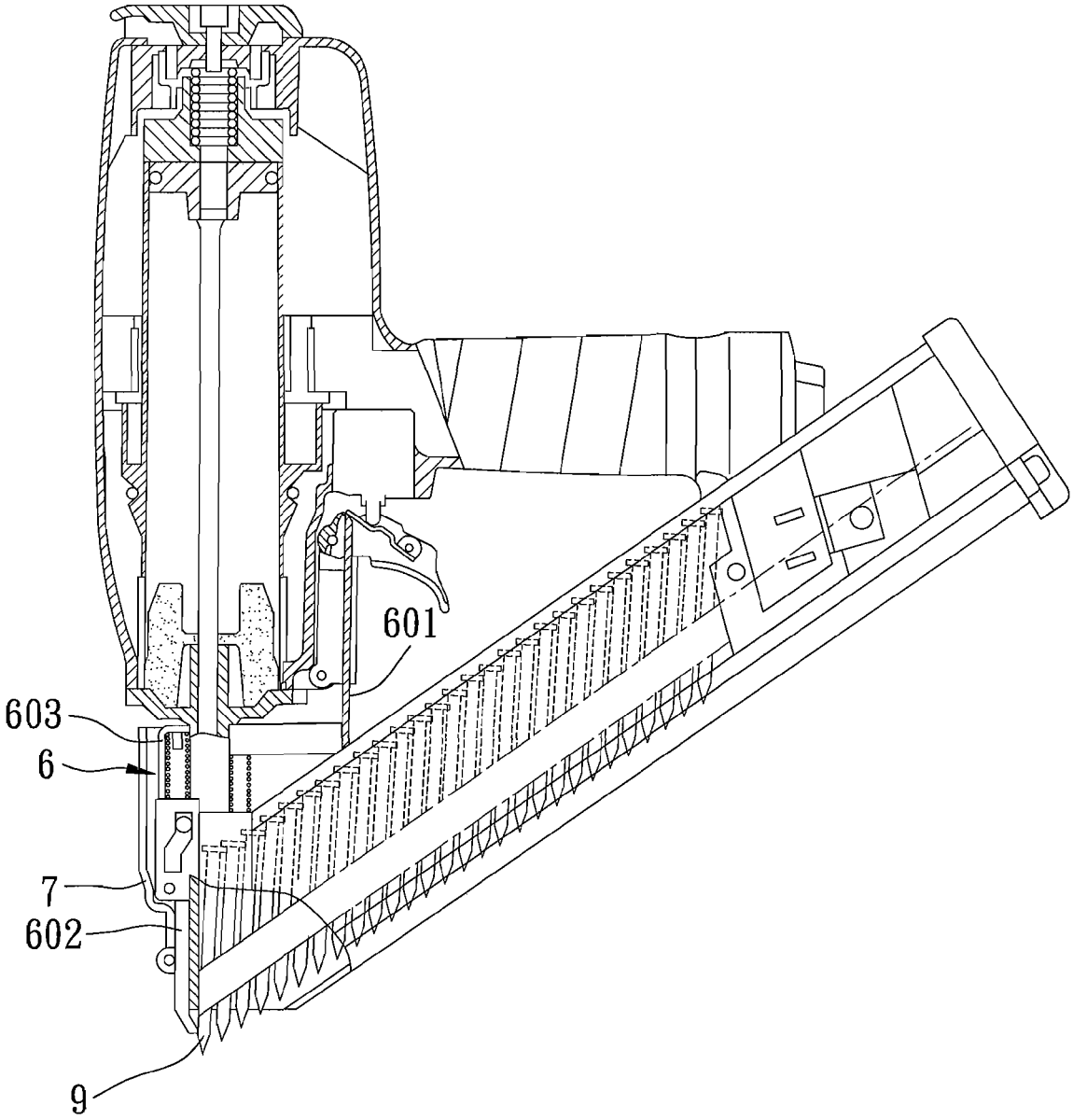
FIG. 2 PRIOR ART
FIG. 2 is a partly sectional side view of the conventional nail gun.
Figure 3:
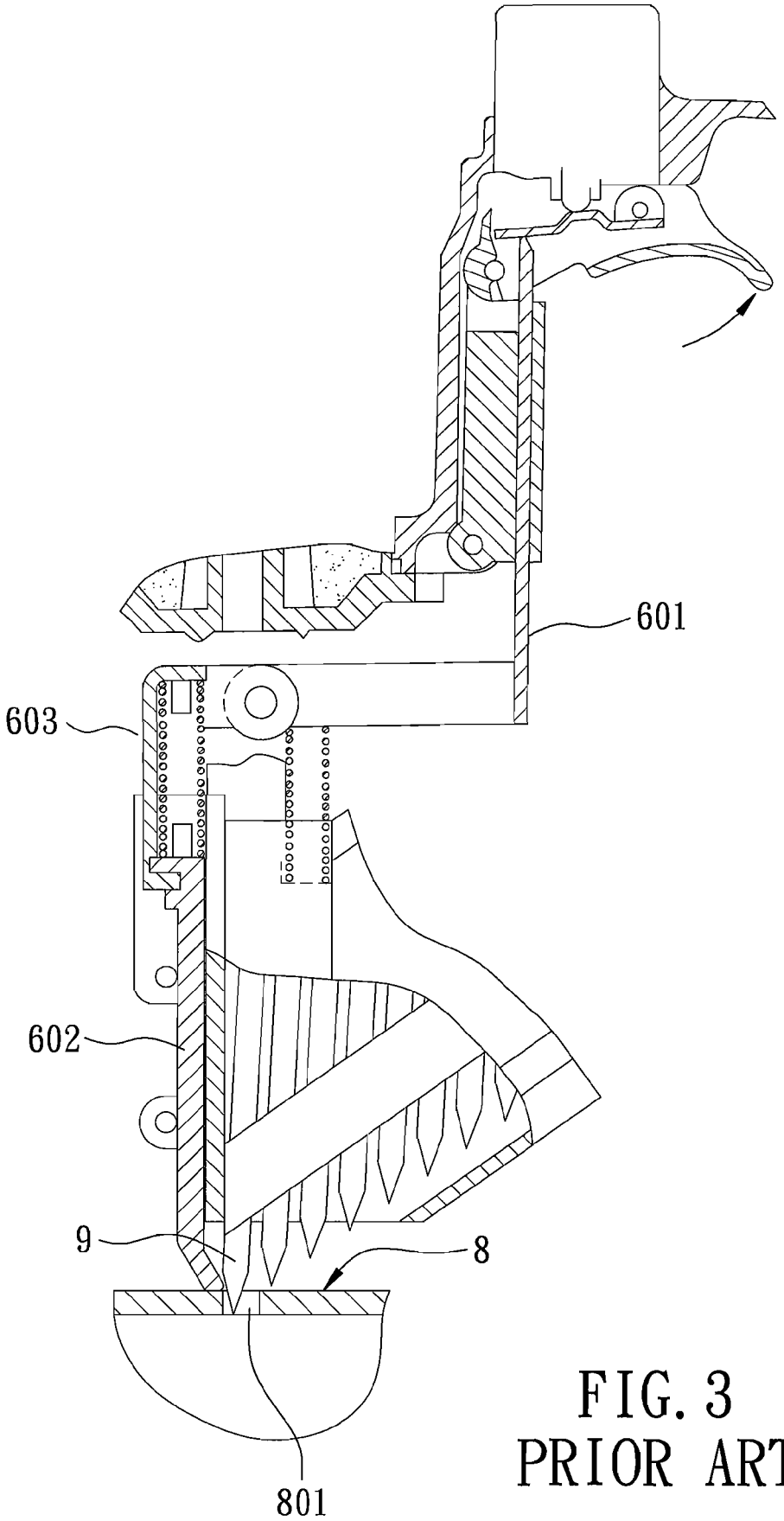
FIG. 3 PRIOR ART
FIG. 3 is a fragmentary, schematic sectional view of the conventional nail gun in a state of use.

The nail-driving device of this invention has the following advantages:

(1) When the driving device is not pressed against the workpiece 100, and when the actuated end 531 of the trigger member 53 is pressed, the locking end 541 of the locking member 54 can obstruct rearward movement of the position-limiting portion 644 of the first safety member 64 to thereby prevent misfires. Due to the design of the locking member 54, there is no need to provide a separating mechanism, such as the cam member 603 (see FIG. 3) of the above-mentioned prior art, for interconnecting the first and second safety members 64, 65. Thus, the first and second safety members 64, 65 can be interconnected fixedly. As a result, the cover 7 (see FIGS. 1 and 2) required for protecting the cam member 603 (see FIG. 3) of the above-mentioned prior art can be omitted to allow the nail 31 projecting from the nail ejection portion 13 to be easily register with the hole 110 in the workpiece 100.

Figure 11:
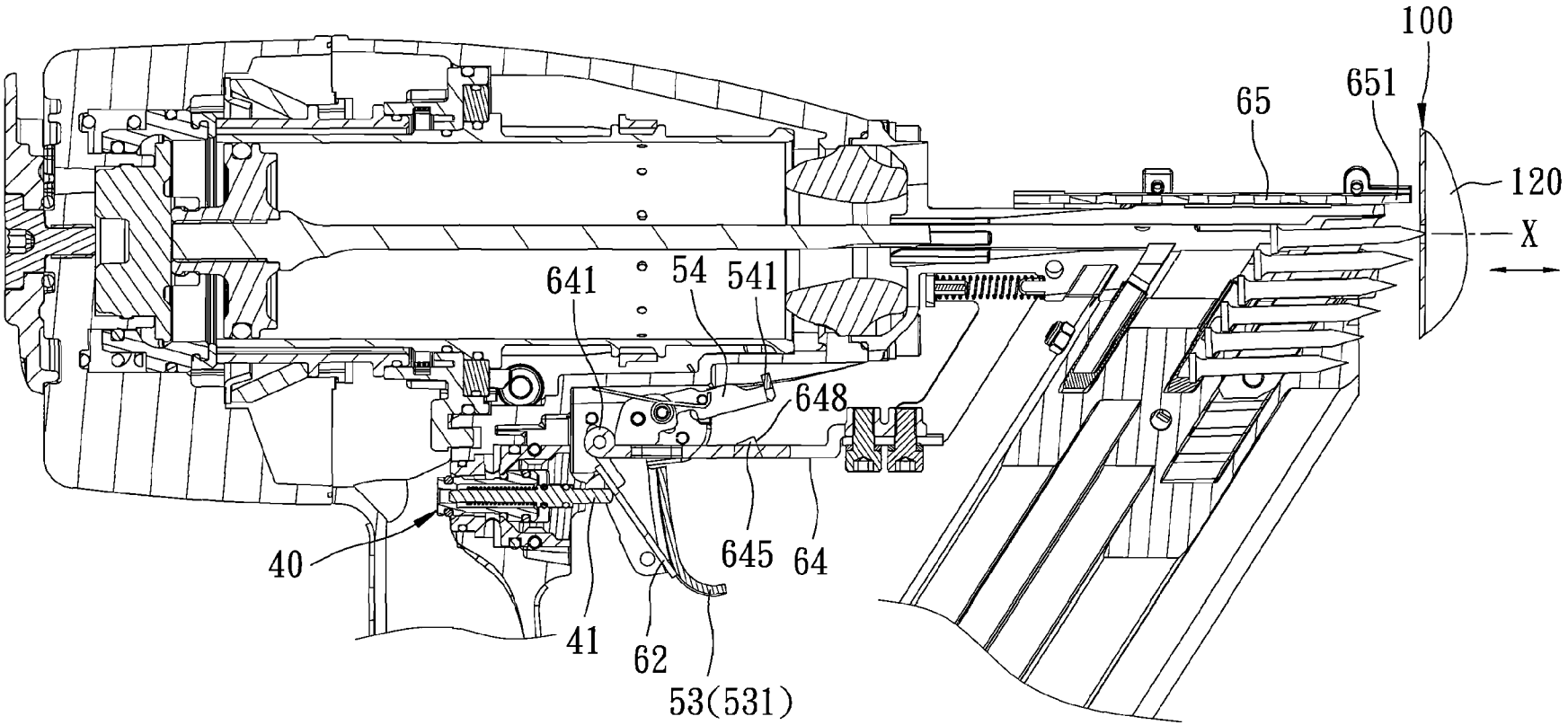
FIG. 11 is a fragmentary schematic sectional side view of the preferred embodiment when the trigger mechanism is disposed in the non-firing position and the safety mechanism is spaced apart from a locking member.
Figure 12:
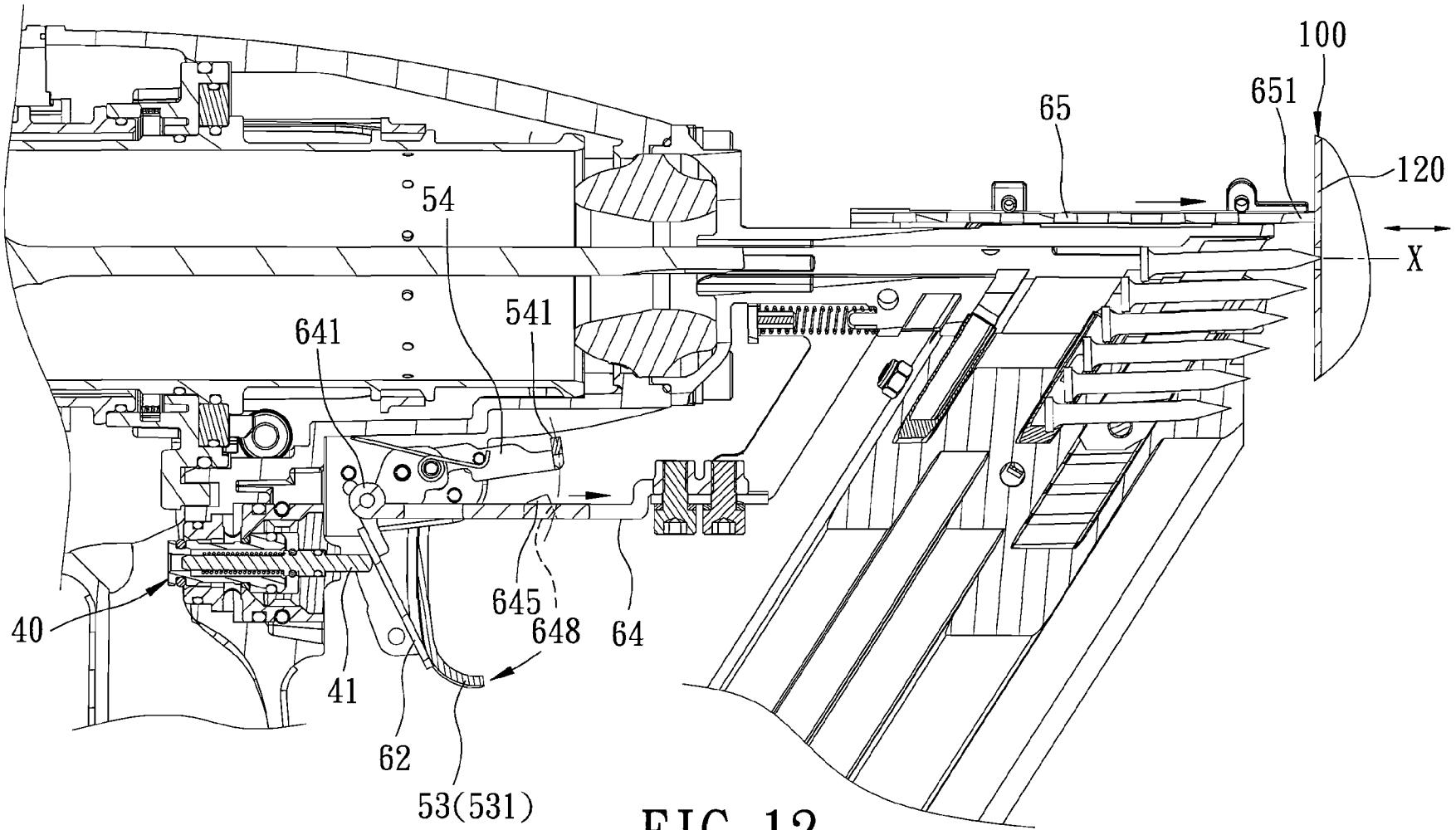
FIG. 12 is a fragmentary schematic sectional side view of the preferred embodiment when the trigger mechanism is pivoted from the non-firing position toward the firing position and a locking end of the locking member is pivoted toward a position-limiting portion of the safety mechanism.
Figure 13:
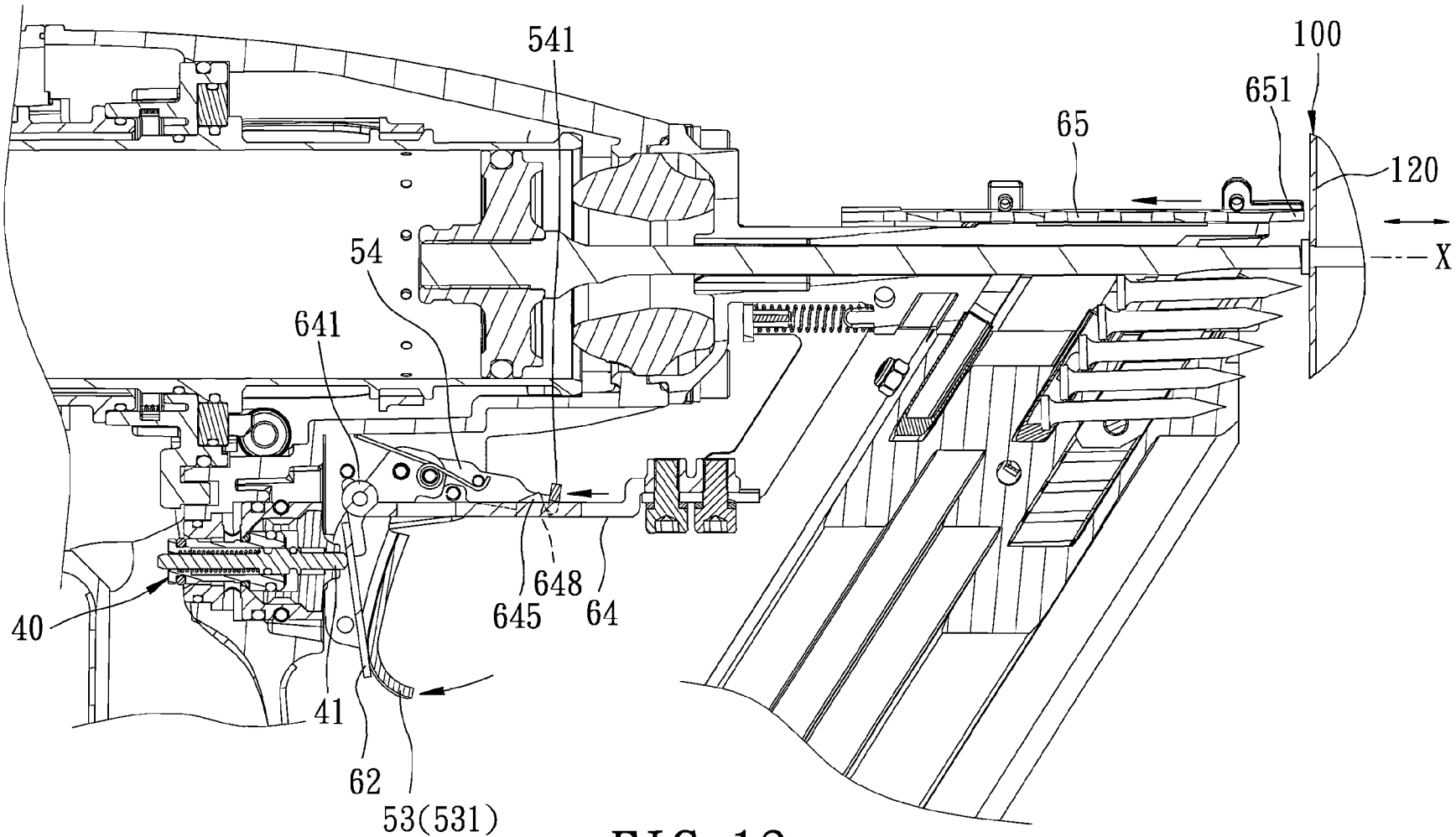
FIG. 13 is a view similar to FIG. 12 but illustrating how the safety mechanism is moved to the first position by the locking member when the trigger mechanism reaches the firing position.

(2) Referring to FIG. 11, in a situation where the workpiece 100 is thin such that, after the tip of the nail 31 projecting from the nail ejection portion 13 is passed through the hole 101 in the workpiece 100 to contact the wall 120, the second distal end 651 of the second safety member 65 is spaced apart from the workpiece 100, when the actuated end 531 of the trigger member 53 is pressed, the force-transmitting member 62 is driven by the trigger member 53 to move the safety mechanism 61 forwardly from the first position such that the contact portion 41 of the activation switch 40 serves as the fulcrum. During forward movement of the safety mechanism 61 from the first position, the locking end 541 of the locking member 54 is pivoted toward the position-limiting blocks 645, as shown in FIG. 12, to a position between the first connecting end 642 of the first safety member 64 and the position-limiting blocks 645 and adjacent to the position-limiting blocks 645. Subsequently, the locking member 54 moves the safety mechanism 61 back to the first position, as shown in FIG. 13. At this time, since the safety mechanism 61 is disposed in the first position, the force-transmitting member 62 can pivot about the first distal end 641 of the first safety member 54 to move the contact portion 41 to thereby activate the activation switch 40.

With this invention thus explained, it is apparent that numerous modifications and variations can be made without departing from the scope and spirit of this invention. It is therefore intended that this invention be limited only as indicated by the appended claims.

We claim:

1. A nail-driving device comprising:

a body having a nail ejection portion extending along an axial direction;

a nail-striking member movable within said body along said axial direction;

an activation switch disposed on said body and having a contact portion, said activation switch being connected to said nail-striking member such that, when said contact portion is moved and thus retracted into said body, said activation switch activates said nail-striking member to move within said body;

a trigger unit including a trigger mechanism disposed pivotally on said body and adjacent to said activation switch, and a first resilient member disposed between said body and said trigger mechanism, said trigger mechanism being pivotable on said body between a non-firing position and a firing position, said first resilient member biasing said trigger mechanism toward said non-firing position; and a safety unit including a safety mechanism movable within said nail ejection portion along said axial direction, a force-transmitting member mounted to said safety mechanism and adjacent to said trigger mechanism, and a second resilient member disposed between said body and said safety mechanism, said safety mechanism having a first distal end, a second distal end opposite to said first distal end, said safety mechanism being movable relative to said nail ejection portion along said axial direction between a first position and a second position farther away from said nail ejection portion than said first position, said second resilient member biasing said safety mechanism toward said first position, said force-transmitting member having a connecting end disposed pivotally on said first distal end of said safety mechanism, and a driven end opposite to said connecting end and adjacent to said trigger mechanism, wherein: when said safety mechanism is limited in said first position, and when said trigger mechanism is pivoted to said firing position, said force-transmitting member moves said contact portion so that said contact portion is retracted into said body; and when movement of said safety mechanism between said first and second positions is allowed, and when said trigger mechanism is pivoted to said firing position, said force-transmitting member is driven by said trigger mechanism to move said safety mechanism from said first position to said second position such that said contact portion serves as a fulcrum.

2. The nail-driving device as claimed in claim 1, wherein said trigger mechanism has an actuated end and a locking end, said safety mechanism further including a position-limiting portion located between said first and second distal ends, said driven end of said force-transmitting member being adjacent to said actuated end of said trigger mechanism;

when said safety mechanism is limited in said first position, and when said trigger mechanism is pivoted to said firing position so that said force-transmitting member moves said contact portion, said locking end of said trigger mechanism is disposed between said position-limiting portion and said second distal end of said safety mechanism and adjacent to said position-limiting portion; and when movement of said safety mechanism between said first and second positions is allowed, and when said trigger mechanism is pivoted to said firing position, said force-transmitting member is driven by said trigger mechanism to move said safety mechanism from said first position to said second position such that said contact portion serves as the fulcrum, and said locking end of said trigger mechanism is disposed between said position-limiting portion and said first distal end of said safety mechanism and adjacent to said position-limiting portion.

3. The nail-driving device as claimed in claim 2, wherein said trigger mechanism further includes a trigger member that has said actuated end and a top end opposite to said actuated end, and a locking member that has said locking end, and a mounting end opposite to said locking end.

4. The nail-driving device as claimed in claim 3, wherein said trigger mechanism further includes a positioning pin extending through said top end of said trigger member and said mounting end of said locking member, and a retaining pin disposed fixedly on said locking member and between said locking end and said mounting end, said first resilient member being configured as a torsion spring and having a spring coil sleeved on said positioning pin, a first distal end foot abutting against said body, and a second distal end foot abutting against said retaining pin.

5. The nail-driving device as claimed in claim 2, wherein said safety mechanism further includes a first safety member, and a second safety member connected fixedly to said first safety member, said first safety member having said first distal end and a first connecting end opposite to said first distal end, said second safety member being disposed movably on said nail ejection portion of said body and having said second distal end and a second connecting end opposite to said second distal end.

6. The nail-driving device as claimed in claim 5, wherein said body further has a first abutment portion disposed at said nail ejection portion, said second safety member having a second abutment portion located between said second distal end and said second connecting end, said second resilient member being configured as a compression spring and having two ends abutting respectively against said first and second abutment portions.

7. The nail-driving device as claimed in claim 5, wherein said first safety member further has an intermediate section extending between said first distal end and said first connecting end along said axial direction, said position-limiting portion being disposed at said intermediate section and including two spaced-apart symmetric position-limiting blocks that are positioned such that, when safety mechanism is limited in said first position, and when said trigger mechanism is pivoted to said firing position, said locking end of said trigger mechanism is disposed between said first connecting end and said position-limiting blocks of said first safety member, and when movement of said safety mechanism between said first and second positions is allowed, and when said trigger mechanism is pivoted to said firing position, said locking end of said trigger mechanism is disposed between said first distal end and said position-limiting blocks of said first safety member.

8. The nail-driving device as claimed in claim 5, wherein:

said locking end of said trigger mechanism has a stop end surface, and a recess formed in a bottom surface thereof and through said locking end along said axial direction, each of said position-limiting blocks having a stop surface facing said first distal end;

when movement of said safety mechanism between said first and second positions is allowed, and when said trigger mechanism is pivoted to said firing position, said locking end portion of said trigger mechanism is disposed between said first distal end of said first safety member and said stop surfaces of said position-limiting blocks and adjacent to said stop surfaces of said position-limiting blocks, and said recess in said locking end of said trigger mechanism engages said intermediate section of said first safety member.

9. The nail-driving device as claimed in claim 8, wherein:

each of said position-limiting blocks further has a first inclined surface facing said first distal end, and a second inclined surface connected to said first inclined surface and facing said first connecting end;

when said safety mechanism is limited in said first position, and when said trigger mechanism is pivoted to said firing position, said locking end of said trigger mechanism is located between said first connecting end of said first safety member and said second inclined surfaces of said position-limiting blocks and adjacent to said second inclined surfaces of said position-limiting blocks.

10. The nail-driving device as claimed in claim 5, wherein said connecting end of said force-transmitting member is disposed pivotally on said first distal end of said first safety member, said force-transmitting member further having a force-transmitting section extending between said connecting end and said driven end and in contact with said contact portion of said activation switch.

11. The nail-driving device as claimed in claim 5, wherein said body further has two guide pins disposed on and above said nail ejection portion and spaced apart from each other along said axial direction, said second safety member extending between said nail ejection portion and said guide pins.

12. The nail-driving device as claimed in claim 5, wherein said body further has an accommodating portion connected to said nail ejection portion, and a handle connected to said accommodating portion, said nail-striking member being disposed movably within said accommodating portion and extending into said nail ejection portion.

13. The nail-driving device as claimed in claim 12, wherein further comprising a magazine connected between said nail ejection portion and said handle.

* * * * *

UNITED STATES PATENT AND TRADEMARK OFFICE

CERTIFICATE OF CORRECTION

PATENT NO. : 7,721,928 B2
APPLICATION NO. : 12/176203
DATED : May 25, 2010
INVENTOR(S) : Jin-Chi Chen et al.

It is certified that error appears in the above-identified patent and that said Letters Patent is hereby corrected as shown below:

At column 8, claim 8, line number 11,

Delete: "claim 5"

And replace with

**claim 7**

Signed and Sealed this
Fourth Day of October, 2011

David J. Kappos

David J. Kappos
*Director of the United States Patent and Trademark Office*